US011090941B2

(12) United States Patent
Andres

(10) Patent No.: US 11,090,941 B2
(45) Date of Patent: Aug. 17, 2021

(54) METHOD AND CLEANING UNIT FOR CLEANING A PRINT HEAD

(71) Applicant: Océ Holding B.V., Venlo (NL)

(72) Inventor: Matthias Andres, Poing (DE)

(73) Assignee: Canon Production Printing Holding B.V., Venlo (NL)

( * ) Notice: Subject to any disclaimer, the term of this patent is extended or adjusted under 35 U.S.C. 154(b) by 0 days.

(21) Appl. No.: 16/654,387

(22) Filed: Oct. 16, 2019

(65) Prior Publication Data

US 2020/0114647 A1 Apr. 16, 2020

(30) Foreign Application Priority Data

Oct. 16, 2018 (DE) ..... 10 2018 125 580.2

(51) Int. Cl.
*B41J 2/165* (2006.01)

(52) U.S. Cl.
CPC ..... *B41J 2/16535* (2013.01); *B41J 2/16517* (2013.01); *B41J 2/16538* (2013.01); *B41J 2/16541* (2013.01); *B41J 2/16544* (2013.01); *B41J 2/16552* (2013.01); *B41J 2002/16573* (2013.01)

(58) Field of Classification Search
CPC ..... B41J 2/16535; B41J 2/16538; B41J 2/16541; B41J 2/16544; B41J 2002/1655; B41J 2/16552; B41J 2002/16558; B41J 2002/16573
See application file for complete search history.

(56) References Cited

U.S. PATENT DOCUMENTS

2012/0194610 A1* 8/2012 Kyoso ..... B41J 2/16552 347/33
2014/0009534 A1 1/2014 Yamamoto et al.
2015/0097882 A1 4/2015 Uchiyama
2016/0152033 A1* 6/2016 Wakabayashi ..... B41J 2/16552 347/28
2017/0282587 A1 10/2017 Koide
2018/0264822 A1* 9/2018 Tanioku ..... B41J 2/16541
2019/0283431 A1* 9/2019 Kikuchi ..... B41J 2/16535

OTHER PUBLICATIONS

German Office Action dated Jul. 9, 2019, for application No. 10 2018 125 580.2.

* cited by examiner

*Primary Examiner* — Matthew Luu
*Assistant Examiner* — Kendrick X Liu
(74) *Attorney, Agent, or Firm* — Schiff Hardin LLP

(57) ABSTRACT

A cleaning unit for cleaning the nozzle plate of a print head of an inkjet printing device having cleaners with respective different levels of cleaning quality and respective different strengths of loading of the nozzle plate. The different cleaners for cleaning the nozzle plate are selected depending on a cleaning indicator in order to achieve an improved compromise between print quality and service life of the print head.

17 Claims, 4 Drawing Sheets

METHOD AND CLEANING UNIT FOR CLEANING A PRINT HEAD

CROSS REFERENCE TO RELATED APPLICATIONS

This patent application claims priority to German Patent Application No. 102018125580.2, filed Oct. 16, 2018, which is incorporated herein by reference in its entirety.

BACKGROUND

Field

The disclosure relates to a method and a cleaning unit for cleaning the nozzle plate of a print head of an inkjet printing device.

Related Art

An inkjet printing device for printing to a recording medium may include one or more print heads, wherein each print head typically has a nozzle plate having a plurality of nozzles. The nozzles are respectively configured to eject ink droplets in order to print dots of a print image onto the recording medium. To clean a print head, the print head may be cleaned in a cleaning unit.

The nozzle plate of a print head typically has a relatively sensitive functional surface (in particular an "anti-wetting coating" (AWC) or an anti-adhesion coating)). After expiration of a defined printing time, or after explicit triggering of a regeneration process of the nozzles of a print head (in particular after triggering of a purge process), the nozzle plate must be cleaned in order to maintain a high print quality.

The repeated cleaning, in particular the repeated wiping, of the nozzle plate of a print head may lead to a negative effect on the functional surface of the nozzle plate. On the other hand, an insufficiently cleaned nozzle plate may lead to a negative effect on the print quality of an inkjet printing device.

BRIEF DESCRIPTION OF THE DRAWINGS/FIGURES

The accompanying drawings, which are incorporated herein and form a part of the specification, illustrate the embodiments of the present disclosure and, together with the description, further serve to explain the principles of the embodiments and to enable a person skilled in the pertinent art to make and use the embodiments.

FIG. 1*a* illustrates an inkjet printing device according to an exemplary embodiment.

FIG. 1*b* illustrates a cleaner with a (e.g. silicone) wiper according to an exemplary embodiment.

FIG. 1*c* illustrates a cleaner with a surge of cleaning fluid according to an exemplary embodiment.

FIG. 1*d* illustrates a cleaner with a cleaning textile according to an exemplary embodiment.

FIG. 2*a* illustrates an inkjet printing device with a plurality of cleaners according to an exemplary embodiment.

FIG. 2*b* illustrates a time curve of the print quality of a print head according to an exemplary embodiment.

Figure 1A:
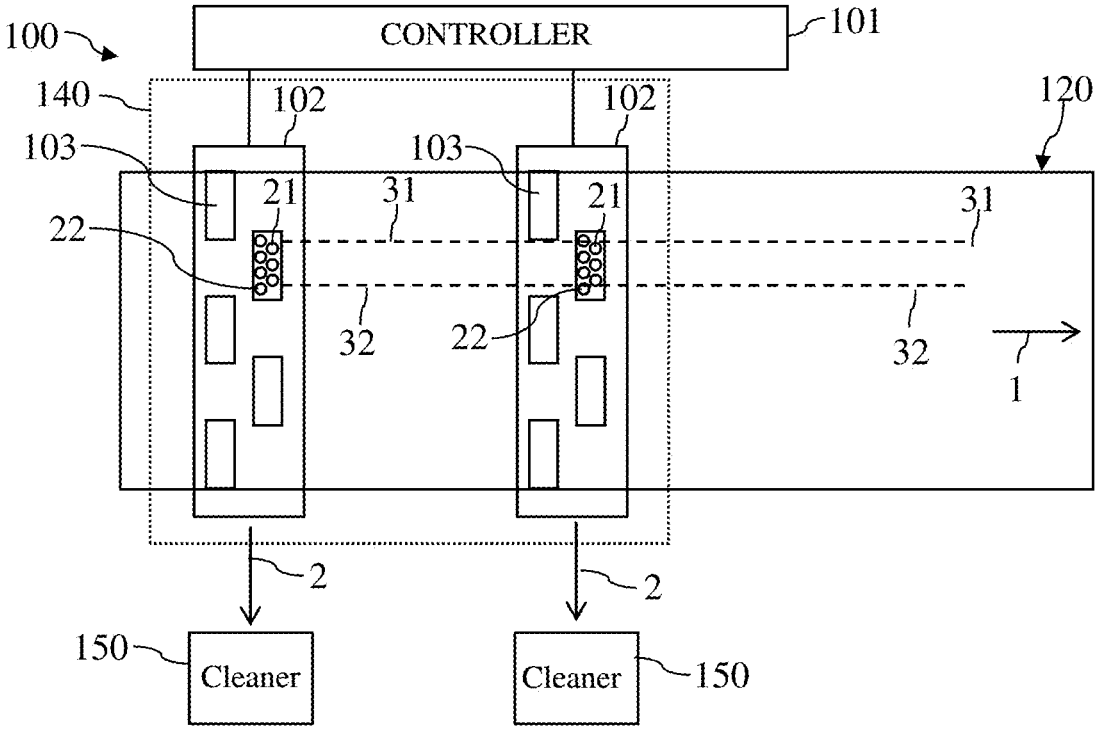

The exemplary embodiments of the present disclosure will be described with reference to the accompanying drawings. Elements, features and components that are identical, functionally identical and have the same effect are—insofar as is not stated otherwise—respectively provided with the same reference character.

DETAILED DESCRIPTION

In the following description, numerous specific details are set forth in order to provide a thorough understanding of the embodiments of the present disclosure. However, it will be apparent to those skilled in the art that the embodiments, including structures, systems, and methods, may be practiced without these specific details. The description and representation herein are the common means used by those experienced or skilled in the art to most effectively convey the substance of their work to others skilled in the art. In other instances, well-known methods, procedures, components, and circuitry have not been described in detail to avoid unnecessarily obscuring embodiments of the disclosure.

An object of the present disclosure is to enable a gentle and reliable cleaning of the nozzle plate of a print head during the operation of a printing device in order to increase the lifespan of the print head given a consistently high print quality.

In an exemplary embodiment, a cleaning unit for a nozzle plate of a print head of an inkjet printing device is described. The cleaning unit includes a first cleaner that is configured to clean the nozzle plate with a relatively low cleaning quality and with a relatively low (in particular mechanical) loading [stressing] of a functional surface of the nozzle plate. Furthermore, the cleaning unit includes a second cleaner that is configured to clean the nozzle plate with a relatively high cleaning quality and with a relatively high (in particular mechanical) loading of the functional surface of the nozzle plate. Moreover, the cleaning unit includes a controller that is configured to determine a cleaning indicator that indicates a need for cleaning of the nozzle plate of the print head. Furthermore, the controller is configured to induce the nozzle plate to be cleaned with the first cleaner and/or with the second cleaner, depending on the cleaning indicator.

In an exemplary embodiment, a method is described for cleaning a nozzle plate of a print head of an inkjet printing device. The inkjet printing device includes a first cleaner that is configured to clean the nozzle plate with a relatively low cleaning quality and with a relatively low loading of the nozzle plate, and a second cleaner that is configured to clean the nozzle plate with a relatively high cleaning quality and with a relatively high loading of the nozzle plate. The method includes the determination of a cleaning indicator that indicates a need for cleaning the nozzle plate of the print head. Moreover, the method includes the cleaning of the nozzle plate with the first cleaner and/or with the second cleaner, depending on the cleaning indicator.

In an exemplary embodiment, the printing device 100 that is depicted in FIG. 1*a* is designed for printing to a recording medium 120 in the form of a sheet or page or plate or band. The recording medium 120 may have been produced from paper, paperboard, cardboard, metal, plastic, textiles, a combination thereof, and/or other materials that are suitable and can be printed to. The recording medium 120 is directed along the transport direction 1 (represented by an arrow) through the print group 140 of the printing device 100.

In the depicted example, the print group 140 of the printing device 100 includes two print bars 102, wherein each print bar 102 may be used for printing with ink of a defined color (for example black, cyan, magenta, and/or yellow, and Magnetic Ink Character Recognition (MICR) ink if applicable). Different print bars 102 may be used for printing with respective different inks.

In an exemplary embodiment, a print bar 102 includes one or more print heads 103 that are, if applicable, arranged side by side in multiple rows in order to print the dots of different columns 31, 32 of a print image onto the recording medium 120. In the example depicted in FIG. 1*a*, a print bar 102 includes five print heads 103, wherein each print head 103 prints the dots of a group of columns 31, 32 of a print image onto the recording medium 120.

In the embodiment depicted in FIG. 1*a*, each print head 103 of the print group 140 includes a plurality of nozzles 21, 22, wherein each nozzle 21, 22 is configured to fire or eject ink droplets onto the recording medium 120. A print head 103 of the print group 140 may, for example, include multiple thousands of effectively utilized nozzles 21, 22 that are arranged along multiple rows, transversal to the transport direction 1 of the recording medium 120. By means of the nozzles 21, 22 of a print head 103 of the print group 140, dots of a line of a print image may be printed onto the recording medium 120 transversal to the transport direction 1, meaning along the width of the recording medium 120.

In an exemplary embodiment, the printing device 100 also includes a controller 101, for example an activation hardware and/or a processor, that is configured to activate the actuators of the individual nozzles 21, 22 of the individual print heads 103 of the print group 140 in order to apply a print image onto the recording medium 120 depending on print data. In an exemplary embodiment, the controller 101 includes processor circuitry that is configured to perform one or more operations and/or functions of the controller 101, including activating the actuators based on print data, and/or controlling to operation of the printer 100 (including controlling one or more components of the printer 100).

The print group 140 of the printing device 100 thus includes at least one print bar 102 with K nozzles 21, 22 that may be activated with a defined line clock cycle in order to print a line, which line travels transversal to the transport direction 1 of the recording medium 120, with K pixels or K columns 31, 32 of a print image onto the recording medium 120, for example with K>1000. In the depicted example, the nozzles 21, 22 are immobile or permanently installed in the printing device 100, and the recording medium 120 is directed past the stationary nozzles 21, 22 with a defined transport velocity.

In an exemplary embodiment, the printing device 100 includes one or more cleaners 150 for the one or more print bars 102. A print bar 102 may be transferred from a printing position, at which the print bar 102 is arranged above the recording medium 120, into a cleaning position at a cleaner 150. For this purpose, the print bar 102 may be moved in the movement direction 2 indicated by the arrow. For each print bar 102, the printing device 100 may have a (possibly precisely one) of the cleaning units described in this document, respectively with one or more cleaners 150.

Figure 1B:
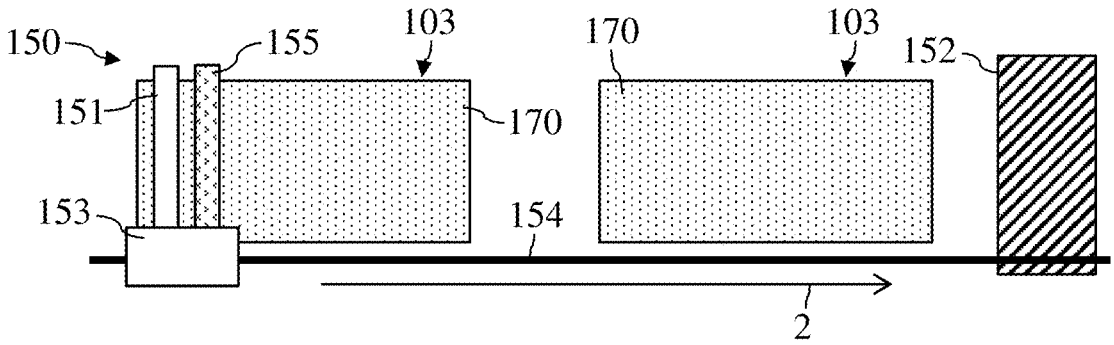

FIG. 1*b* shows the underside or the nozzle plates 170 of two print heads 103 of a print bar 102 at a cleaner 150. The outputs of the one or more nozzles 21, 22 of the print head 103 are arranged at the underside or the nozzle plate 170 of a print head 103. The nozzle plate 170 of a print head 103 may initially be sprayed with a cleaning agent by one or more spray nozzles 155 of the cleaner 150. Furthermore, the one or more nozzles 21, 22 of the print head 103 may be induced to eject ink, for example by increasing the pressure within the one or more nozzles 21, 22. This step is typically referred to as "purging" or regeneration. The nozzle plate 170 of a print head 103 may subsequently be cleaned with a wiper 151. The wiper 151 may be moved along the movement direction 2, across the nozzle plate 170 of a print head 103, in order to clean the nozzle plate 170 of remaining ink. This step is typically referred to as "wiping".

In an exemplary embodiment, the wiper 151 is attached to a sled 153 that is directed along a guide rail 154 at the nozzle plate 170 of a print head 103. The sled 153 may thereby guide the wiper 151 across the nozzle plates 170 of a plurality of (in particular all) print heads 103 of a print bar 102. The fluid (made up of ink and cleaning fluid) that is thereby wiped off may drip into a pan (not shown), wherein the pan is arranged below the sled 153. After the nozzle plates 170 of the one or more print heads 103 have been wiped off, the wiper 151 may be directed to a wiper cleaning 152 via which the wiper 151 is cleaned.

A reliable cleaning of the nozzle plate 170 of a print head 103 may typically be produced via a cleaner 150 having a wiper 151, for example a wiper 151 made of silicone. On the other hand, the mechanical action of the wiper 151 on the nozzle plate 170 most often leads to a relatively stark negative effect on the functional surface (in particular the "anti-wetting coating") of the nozzle plate 170, and thus to a reduced lifespan of said nozzle plate 170.

Figure 1C:
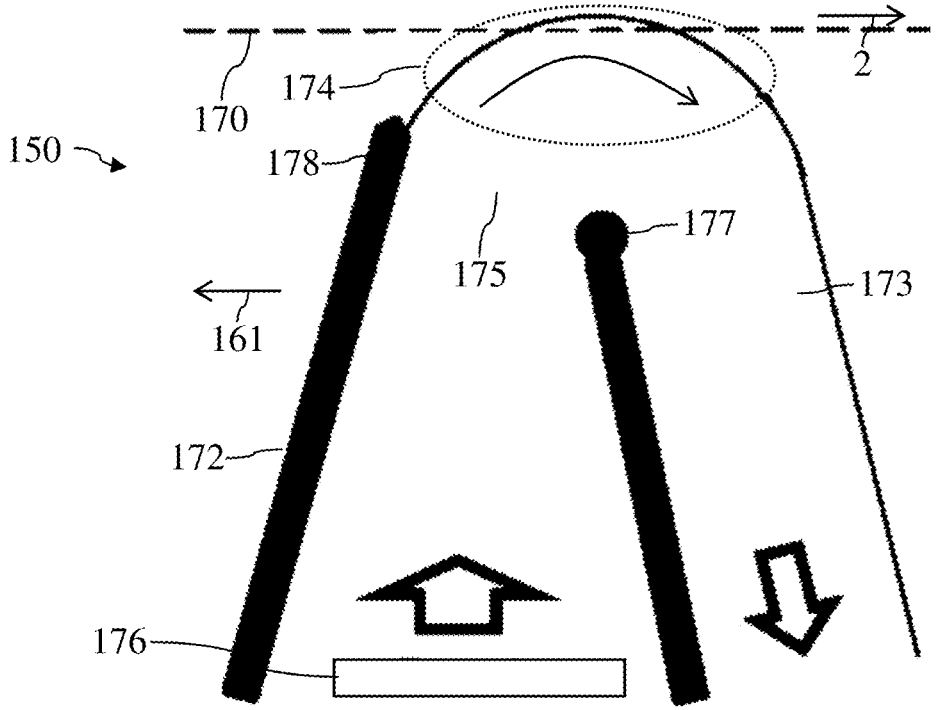

FIG. 1*c* shows a cleaner 150, according to an exemplary embodiment, with a cleaning nozzle 172 that is configured to generate a wave or a surge 174 of cleaning fluid 173. A fluid opening 175 of the cleaning nozzle 172 is directed upward so that cleaning fluid 173 may flow downward, against the nozzle plate 170. Cleaning fluid 173 is conveyed out of the cleaning nozzle 172 through the fluid opening 175 due to an actuator, for example due to a pump, of said cleaning nozzle 172. The cleaning nozzle 172 may have an overflow 177 on at least one side of the cleaning nozzle 172. The cleaning fluid 173 flowing out of the fluid nozzle 175 is deflected by the force of gravity and then flows or streams away again over the overflow 177 (for example into a capture container, not shown). A wave or a surge 174 of cleaning fluid 173 is thus created above the fluid opening 175 of the cleaning nozzle 172.

This wave 174 is arranged above the cleaning nozzle 172, in particular above the fluid opening 175 of the cleaning nozzle 172. The cleaning fluid 173 may be directed through a guide wall 178 at the fluid opening 175 of the cleaning nozzle 172, such that the wave 174 of cleaning fluid 173 reliably results via the overflow 177.

In an exemplary embodiment, the nozzle plate 170 of a print head 103 and the cleaning nozzle 172 may be moved relative to one another along the movement direction 2 in order to guide the nozzle plate 170 through the surge 174 of cleaning fluid 173. A particularly gentle cleaning of the nozzle plate 170 of a print head 103 is enabled via the cleaning by means of a surge 174 of cleaning fluid 173, whereby the service life of the print head 103 is increased. On the other hand, the cleaning quality that may be achieved with such a surge cleaning is typically less than the cleaning quality that may be achieved with a wiper 151.

Figure 1D:
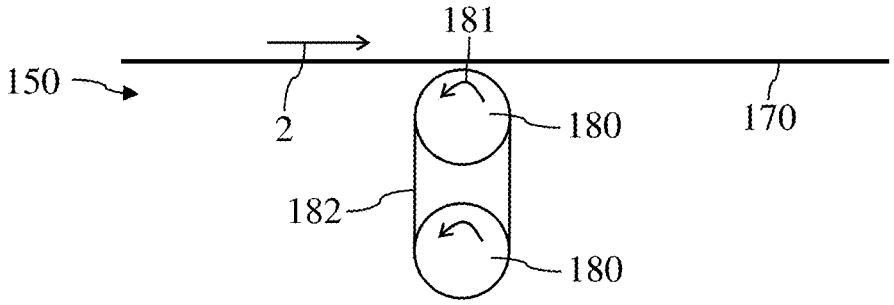

FIG. 1*d* shows a cleaner 150, according to an exemplary embodiment, that includes a cleaning textile 182 that may be directed across the nozzle plate 170 of a print head 103 in order to wipe off the nozzle plate 170 with said cleaning textile 182 (for example a felt cloth). In an exemplary embodiment, the cleaning textile 182 is configured as a continuous belt that, via rollers 180 that rotate in the rotation direction 181 indicated by the arrow, is directed past the nozzle plate 170 of a print head 103 in order to wipe off said nozzle plate 170 with said cleaning textile 182. The cleaning textile 182 and the nozzle plate 170 of a print head 103 may be moved relative to one another along the movement direction 2 in order to clean the entire nozzle plate 170.

In an exemplary embodiment, the loading, in particular the mechanical loading, of the cleaning by means of a cleaning textile 182 is less than the loading given use of a wiper 151, but greater than given use of a surge 174 of cleaning fluid 173. Furthermore, in an exemplary embodiment, the cleaning quality of the cleaning by means of a cleaning textile 182 is less than the cleaning quality given use of a wiper 151, but greater than given use of a surge 174 of cleaning fluid 173.

In an exemplary embodiment, different cleaning methods thus exist for cleaning the nozzle plate 170 of a print head 103, which cleaning methods differ from one another with regard to the respective loading of the functional surface of the nozzle plate 170 and/or in relation to the respective achieved cleaning quality. A cleaning method may have a cleaning effect that is insufficient for a production environment, such that a manual cleaning cannot be foregone given sole use of the cleaning method. On the other hand, a cleaning method may possibly be too abrasive in the long run with regard to the functional surface of the nozzle plate 170 of a print head 103, such that the service life of the print head 103 is reduced.

In an exemplary embodiment, an inkjet printing device 100 may have one of the cleaners 150 depicted in FIGS. 1*b*, 1*c*, and 1*d* in order to clean the nozzle plate 170 of a print head 103 with a spray-wipe method (FIG. 1*b*), a tissue-wipe method (FIG. 1*d*), or a surge cleaning method (FIG. 1*c*). Depending on the cleaning method, the regeneration (via purging) of a print head 103 and the subsequent cleaning of the nozzle plate 170 of said print head 103 with one of the described cleaning methods may be implemented after a fixed time interval or after a fixed defined number of print pages, for example. Furthermore, manual cleaning steps may be necessary depending on the cleaning method that is used.

In an exemplary embodiment, in order to provide a printing device 100 with an improved compromise with regard to the cleaning quality and with regard to the service life of a print head 103, a plurality of printing modules 150 that may clean a nozzle plate 170 with respective different cleaning methods may be installed in a printing device 100 for the cleaning of a print head 103 or for the cleaning of the print heads 103 of a print bar 102. The different cleaning methods may thereby differ with regard to the cleaning quality and with regard to the extent of the negative effect on the nozzle plate 170. A printing device 100 having a plurality of cleaners 150, 250 is depicted by way of example in FIG. 2*a*.

Furthermore, the respectively used form of the print head regeneration and/or the subsequent print head cleaning may be specifically chosen using the evaluated print quality, and/or using the print data 201 that has been or is to be printed, and/or using general parameters 202 such as quality of the recording medium 120, ambient climate, print environment etc. The mechanical loading of the functional surface of a nozzle plate 170 may thus be reduced. For example, as depicted in FIG. 2*a*, two cleaners 150, 250 with two print head cleaning methods having different modes of action may be provided that may be used to clean the nozzle plate 170 of the print head 103 depending on the current print quality of a print head 103.

Figure 2A:
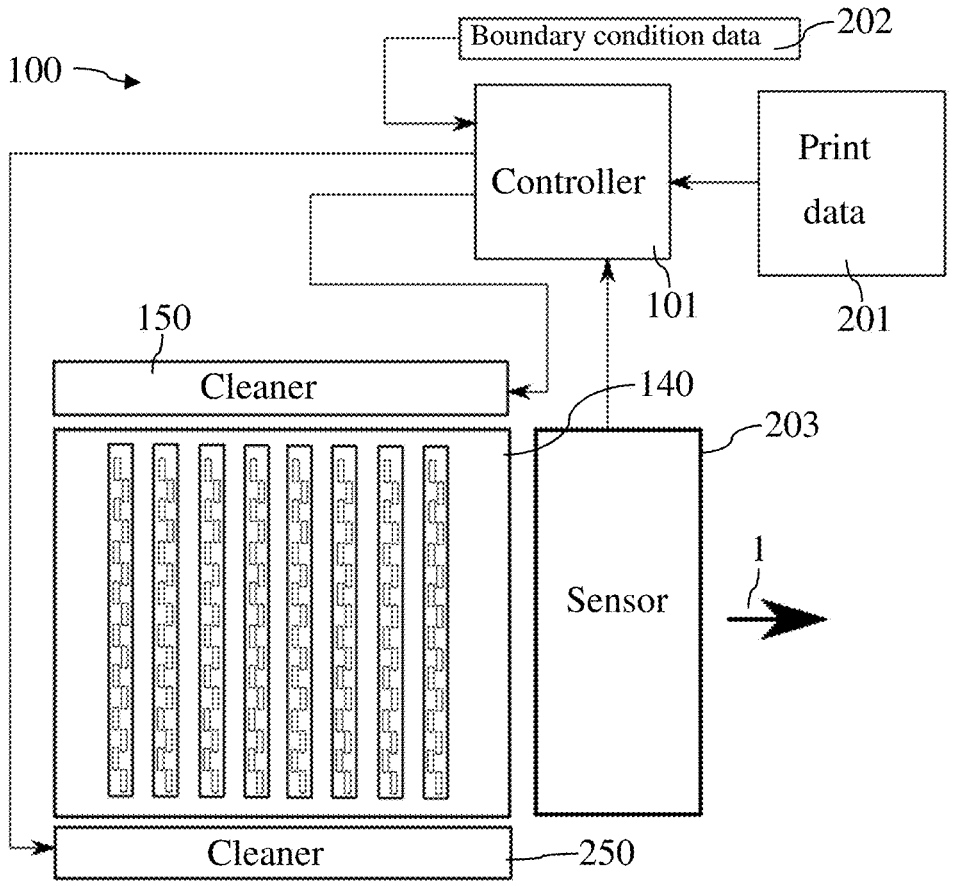

In an exemplary embodiment, the printing device 100 depicted in FIG. 2*a* includes a sensor 203 that is configured to capture sensor data, in particular image data, with regard to a print image printed by the print group 140. The print quality of a print head 103 may be determined on the basis of the sensor data. For example, the controller 101 of the printing device 100 may be configured to compare the sensor data with regard to a printed print image with the print data 201 for the printed print image, in order to assess the print quality of a print head 103. Furthermore, the controller 101 may be configured to determine boundary condition data 202 with regard to one or more boundary conditions of the printing device 100. Examples of boundary condition data 202 are the ambient temperature, the humidity, an emission (for example water vapor) of the printing device 100 etc.

Figure 2B:
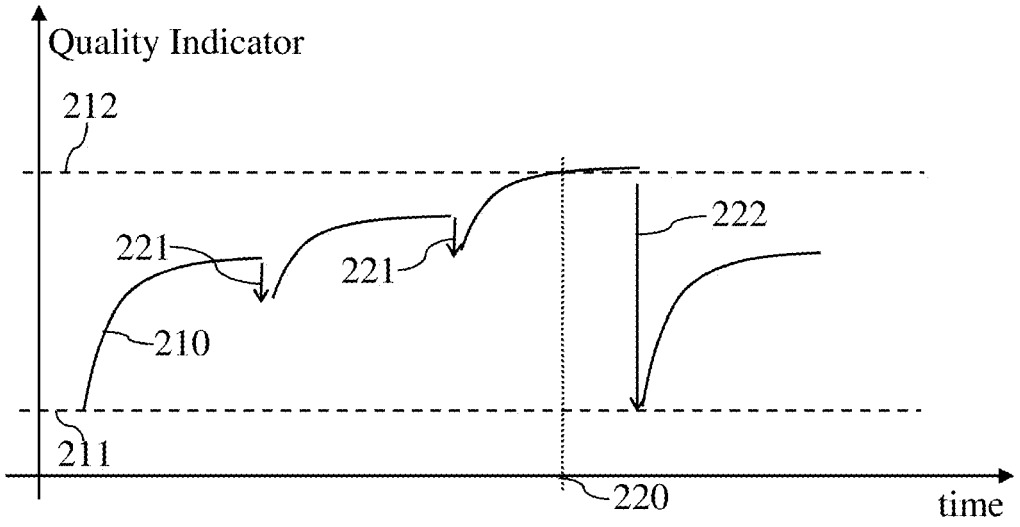

FIG. 2*b* shows examples of time curves 210 of the print quality during the printing operation of a printing device 100. The print quality may be assessed via a quality indicator that, for example, indicates the extent of a lateral offset of dots transversal to the transport direction 1. The print quality may be considered to be optimal if the quality indicator has a first value 211. The print quality typically decreases during the printing operation, which is indicated by an increasing quality indicator in the example depicted in FIG. 2*b*. After expiration of a defined time interval, a cleaning may be implemented according to a cleaning method 221, 222 dependent on the value of the quality indicator. If a sufficiently high print quality is still present after the time interval, in particular if the quality indicator is less than a second value 212, a first cleaning method 221 (for example a surge cleaning) may be used that enables a gentle cleaning although it has a relatively low cleaning quality. As depicted in FIG. 2*b*, an increase in the print quality (but not up to the optimal print quality) may be produced via the cleaning by means of the first cleaning method 221.

The print quality may then be repeatedly checked and a suitable cleaning method 221, 222 may be selected. If, at a defined point in time 220, it turns out that the quality indicator has reached or exceeded a second value 212, a second cleaning method 222 (for example a tissue cleaning) may thus be selected in order to achieve a high cleaning quality again (in particular an optimal print quality).

A cleaning indicator may thus be determined on the basis of the sensor data of the sensor 203 and/or on the basis of the boundary condition data 202, which cleaning indicator may be used to select the point in time for the cleaning and/or a suitable cleaning method 221, 222 for the cleaning of the nozzle plate 170 of a print head 103. A high print quality may thus be maintained, and the loading of the functional surface of the nozzle plate 170 of a print head 103 may be reduced. As a result of this, the service life of a print head 103 may be increased. A suitable, and thereby sufficiently good, print head cleaning method 221, 22 may be applied on the basis of the cleaning indicator following a regeneration (i.e. following a purge process). Furthermore, the frequency of the print head cleaning may be reduced. Manual cleaning measures may also possibly be foregone.

Figure 3:
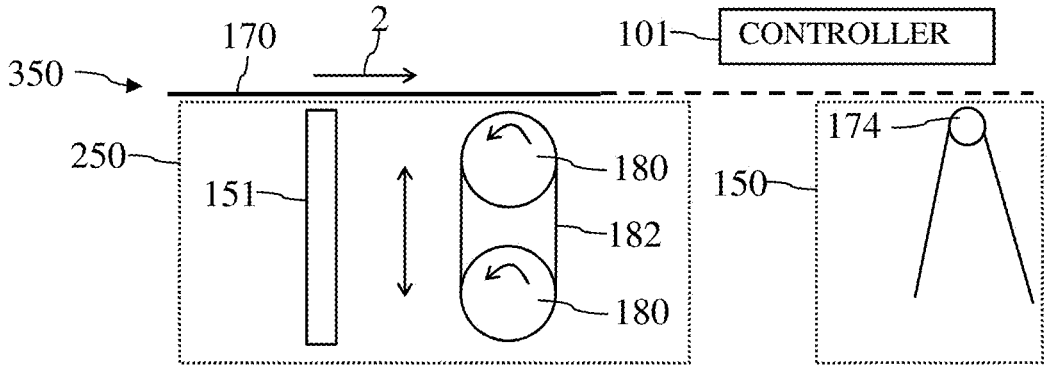
FIG. 3 illustrates a cleaning unit with a plurality of cleaners according to an exemplary embodiment.

FIG. 3 shows a cleaning unit 350, according to an exemplary embodiment, for a nozzle plate 170 of a print head 103 of an inkjet printing device 100. The cleaning unit 350 includes a first cleaner 150. The first cleaner 150 may be configured to clean the nozzle plate 170 with a first cleaning method 221. In particular, the first cleaner 150 may be configured to clean the nozzle plate 170 with a relatively low cleaning quality and/or with a relatively low loading of the functional surface (in particular of an anti-adhesion coating) of the nozzle plate 170. The first cleaner 150 may be configured to clean the nozzle plate 170 with a surge 174 of a cleaning fluid 173.

In an exemplary embodiment, the cleaning unit 350 includes a second cleaner 250. The second cleaner 250 may be configured to clean the nozzle plate 170 with a second cleaning method 222. In particular, the second cleaner 250 may be configured to clean the nozzle plate 170 with a relatively high cleaning quality and/or with a relatively high loading of the functional surface of the nozzle plate 170. For example, the second cleaner 250 may be configured to wipe off the nozzle plate 170 with a (typically elastic) (silicone) wiper 151 and/or with a cleaning textile 182.

In an exemplary embodiment, the cleaning unit 350 includes a controller 101 (for example as part of the controller 101 of an inkjet printing device 100 that includes the cleaning unit 350). The controller 101 is configured to determine a cleaning indicator that indicates a need for cleaning of the nozzle plate 170 of the print head 103. In particular, the cleaning indicator may indicate whether the nozzle plate 170 of the print head 103 needs to be cleaned or not (for example because the print head 103 no longer exhibits a sufficiently high print quality). Furthermore, the cleaning indicator may indicate whether a cleaning with a high cleaning quality is required, or whether a cleaning with a reduced cleaning quality is sufficient. Alternatively or additionally, the cleaning indicator may indicate which cleaning method 221, 222 should be implemented.

The cleaning indicator may, for example, include a value that indicates the urgency (priority) and/or the required intensity of a cleaning of the nozzle plate 170 of the print head 103. For example, a relatively high value may indicate that an intensive cleaning (for example by means of the second cleaning method 222) is required, and/or a medium value may indicate that a moderate cleaning (for example by means of the first cleaning method 221) is sufficient, and/or a low value may indicate that no cleaning is necessary. Alternatively, the assignment between values of the cleaning indicator and the necessity of cleaning may be chosen to be precisely the reverse.

In an exemplary embodiment, the controller is configured to determine the cleaning indicator on the basis of print image sensor data with regard to a print image printed with the print head 103. The inkjet printing device 100 may include a sensor 203 (for example an inline scanner) that is configured to record print image sensor data, in particular image data, of a print image printed onto a recording medium 120. On the basis of the print image sensor data, for example, it may be recognized whether one or more nozzles 21, 22 of the print head have failed or exhibit an incorrect positioning transversal to the transport direction 1 of the recording medium 120. The cleaning indicator may depend on the type and/or the dimension of the negative effects on the nozzle. For example, the cleaning indicator may indicate that an intensive cleaning (for example by means of the second cleaning method 222) is necessary if the print head 103 exhibits one or more nozzle failures. Furthermore, the intensity of the required cleaning that is indicated by the cleaning indicator may be increased with increasing extent of the negative effects on the nozzle (for example with increasing extent of the streaking of the printed print image).

In an exemplary embodiment, the controller 101 is configured to determine, on the basis of the print image sensor data, a time curve 210 of a quality indicator for the quality of the print image printed with the print head 103. The quality indicator may thereby depend on the type and/or the extent of the negative effects on the nozzle. The chronological development of the print quality may thus be determined. The cleaning indicator may then be determined on the basis of the time curve 210, in particular on the basis of a value and/or a slope of the time curve 210. For example, a relatively rapid worsening of the print quality may have the effect that the intensity of the necessary cleaning that is indicated by the cleaning indicator is increased.

Alternatively or additionally, in an exemplary embodiment, the controller 101 is configured to determine the cleaning indicator on the basis of boundary condition data 202, wherein the boundary condition data 202 indicate one or more boundary conditions for the printing operation of the printing device 100. Examples of boundary conditions are: the temperature in an environment of the print head 103; the humidity in the environment of the print head 103; a type and/or a property of the recording medium 120 that is printed to by the print head 103; and/or a type and/or a property of ink that is ejected by the print head 103. For example, a relatively high ambient temperature and/or a relatively low humidity may have the effect that the intensity of the required cleaning that is indicated by the cleaning indicator is increased. Furthermore, the use of a relatively rapidly drying ink may have the effect that the intensity of the required cleaning that is indicated by the cleaning indicator is increased.

Alternatively or additionally, in an exemplary embodiment, the controller 101 is configured to determine a degree of the intensity with which the print head 103 has been used since a most recent cleaning. For example, the degree of the intensity may depend on the number of print pages that are printed per time unit. Alternatively or additionally, the degree of the intensity may depend on the complexity of the print images that are to be printed (wherein the complexity may be determined from the print data 201 for the print images to be printed). The cleaning indicator may then (possibly also) be determined on the basis of the determined degree of the intensity. For example, a relatively high degree of the intensity may have the effect that the intensity of the required cleaning that is indicated by the cleaning indicator is increased.

An individual cleaning requirement for a print head 103 or for the print heads 103 of a print bar 102 of a printing device 100 may thus be determined on the basis of a plurality of data, wherein the cleaning requirement is indicated by a cleaning indicator. If applicable, a dedicated cleaning indicator may thereby be determined for each print head 103 or for each print bar 102 of the printing device 100. Furthermore, if applicable an individual cleaning method 221, 22 may be selected for each print head 103 or for each print bar 102 of the printing device 100 on the basis of the individual cleaning indicator. The service life of the print heads 103 of a printing device 100 may thus be further increased.

In an exemplary embodiment, the controller 101 is also configured to initiate that the nozzle plate 170 is cleaned with the first cleaner 150 and/or with the second cleaner 250, depending on the cleaning indicator. In particular, whether a cleaning of the nozzle plate 170 must take place or not may be determined at a defined point in time 220 on the basis of the current cleaning indicator. Furthermore, which of the one or more cleaning methods 221, 222 should be used for cleaning of the nozzle plate 170 may be determined.

In an exemplary embodiment, the controller 101 is configured to use the first cleaner 150, but not the second cleaner 250, to clean the nozzle plate 170 if the cleaning indicator indicates a relatively low need for cleaning of the nozzle plate 170 of the print head 103. It may thus be produced that the functional surface of the nozzle plate 170 is only relatively slightly negatively affected, but nevertheless is sufficiently thoroughly cleaned.

On the other hand, in an exemplary embodiment, the controller 101 is configured to use the second cleaner 250 for cleaning of the nozzle plate 170 (possibly in combination with the first cleaner 150) if the cleaning indicator indicates a relatively great need for cleaning of the nozzle plate 170 of the print head 103. A thorough cleaning of the nozzle plate 170 may thus be produced (only when necessary), whereby a relatively great negative effect on the functional surface of the nozzle plate 170 may be caused, however.

In particular, the nozzle plate 170 may be cleaned with the first cleaner 150 and/or with the second cleaner 250, depending on the cleaning indicator, in order to have the effect that the print quality produced by the print head 103 does not fall below a minimum quality, and that the service life of the functional surface of the nozzle plate 170 does not fall below a minimum duration. In other words, the respective cleaning method 221, 222 that is sufficient to achieve the minimum quality and that causes an optimally small negative effect on the functional surface of the nozzle plate 170 of the print head 103 may be selected during the printing operation of the printing device 100.

A cleaning unit 350, according to an exemplary embodiment, for cleaning of the nozzle plate 170 of a print head 103 of an inkjet printing device 100 is thus described that has a plurality of cleaners 150, 250 with respective different levels of cleaning quality and respective different strengths of loading of the nozzle plate 170. The different cleaners 150, 250 are selected for cleaning of the nozzle plate 170 depending on a cleaning indicator in order to achieve an improved compromise between print quality and service life of the print head 103.

In an exemplary embodiment, the controller 101 is configured to determine the cleaning indicator at a sequence of points in time 220, wherein the points in time 220 follow one another with a defined frequency (for example 0.01 Hz, 0.1 Hz, 1 Hz, or more), for example. The cleaning indicator may be determined at each point in time, and whether a cleaning needs to be implemented, and if applicable which cleaning method 221, 222 should be used for this, may be decided on the basis of the cleaning indicator. A high print quality may thus be maintained during the printing operation of a printing device 100.

In an exemplary embodiment, the first cleaner 150 and the second cleaner 250 may be arranged along an axis such that the nozzle plate 170 of the print head 103 may be cleaned by both the first cleaner 150 and the second cleaner 250 with a single translatory movement. The translatory movement may thereby travel orthogonal to the transport direction 1 of the recording medium 120 that is printed to by the print head 103. In particular, the print head 103 (or the print bar 102 in which the print head 103 is located) may be moved along the movement direction 2 from a printing position (above the recording medium 120) into a cleaning position. The movement between the printing position and the cleaning position may correspond to the aforementioned translatory movement. Via such an arrangement of the cleaners 150, 250, a plurality of cleaners 150, 250 for different cleaning methods 221, 222 may be particularly efficiently provided in a printing device 100.

In an exemplary embodiment, the second cleaner 250 is configured to be moved past the nozzle plate 170 and/or away from the nozzle plate 170 in order to enable or prevent a cleaning with the second cleaner 250. This is indicated by the double arrow in FIG. 3. A cleaning with the second cleaning method 222 may be particularly efficiently enabled or prevented.

The first and/or the second cleaner 150, 250 may have one or more operating parameters via which the cleaning quality of the respective cleaner 150, 250 and/or the (mechanical) loading of the functional surface of the nozzle plate 170 to be cleaned may be varied. In particular, the cleaning quality but typically also the loading of the nozzle plate 170 that is to be cleaned are possibly increased by increasing or reducing the value of an operating parameter of a cleaner 150, 250.

In an exemplary embodiment, given a cleaner 150, 250 with a cleaning textile 182, the following are set as operating parameters:

- the movement velocity of the cleaning textile 182 or the rotation speed of the one or more rollers 180 for movement of the cleaning textile 182;
- the translatory velocity of the cleaning textile 182 given the translatory movement along the nozzle plate 170 (meaning along the movement direction 2);
- the relative velocity between the rotation speed of the one or more rollers 180 and the translatory velocity;
- the force with which the cleaning textile 182 is pressed against the nozzle plate 170; and/or
- the material (in particular the hardness of the material) of the roller 180 with which the cleaning textile 182 is pressed against the nozzle plate.

In an exemplary embodiment, given a cleaner 150, 250 with a wiper 151,

- the force with which the wiper 151 is pressed against the nozzle plate 170;
- the material of the wiper 151; and/or
- the translatory velocity of the wiper 151 along the nozzle plate 170 may be set as operating parameters, for example.

In an exemplary embodiment, the controller 101 is configured to set or adapt the value of one or more operating parameters of the first and/or second cleaner 150, 250, in particular depending on the cleaning indicator. The compromise between cleaning quality and loading of the nozzle plate 170 of a print head 103 may thus be further improved.

Furthermore, described in this document is an inkjet printing device 100 that includes the cleaning unit 350 described in this document.

Figure 4:
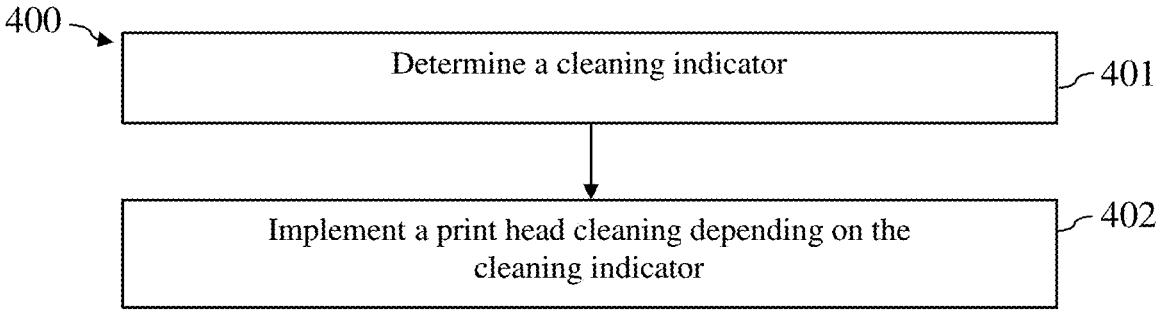
FIG. 4 illustrates a flowchart of a method for cleaning a print head according to an exemplary embodiment.

FIG. 4 shows a flowchart of a method 400, according to an exemplary embodiment, for cleaning a nozzle plate 170 of a print head 103 of an inkjet printing device 100. The inkjet printing device 100 includes a first cleaner 150 for cleaning the nozzle plate 170 by means of a first cleaning method 221 and a second cleaner 250 for cleaning the nozzle plate 170 by means of a second cleaning method 222. The method 400 may be executed by a controller 101 of the printing device 100.

In an exemplary embodiment, the method 400 includes the determination 401 of a cleaning indicator that indicates a need for cleaning of the nozzle plate 170 of the print head 103. Furthermore, the method 400 includes the cleaning 402 of the nozzle plate 170 with the first cleaner 150 and/or with the second cleaner 250 depending on the cleaning indicator, in particular such that a compromise between the print quality of the printing device 100 and the service life of the print head 103 is improved.

CONCLUSION

The aforementioned description of the specific embodiments will so fully reveal the general nature of the disclosure that others can, by applying knowledge within the skill of the art, readily modify and/or adapt for various applications such specific embodiments, without undue experimentation, and without departing from the general concept of the present disclosure. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

References in the specification to "one embodiment," "an embodiment," "an exemplary embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The exemplary embodiments described herein are provided for illustrative purposes, and are not limiting. Other exemplary embodiments are possible, and modifications may be made to the exemplary embodiments. Therefore, the specification is not meant to limit the disclosure. Rather, the scope of the disclosure is defined only in accordance with the following claims and their equivalents.

Embodiments may be implemented in hardware (e.g., circuits), firmware, software, or any combination thereof. Embodiments may also be implemented as instructions stored on a machine-readable medium, which may be read and executed by one or more processors. A machine-readable medium may include any mechanism for storing or transmitting information in a form readable by a machine (e.g., a computer). For example, a machine-readable medium may include read only memory (ROM); random access memory (RAM); magnetic disk storage media; optical storage media; flash memory devices; electrical, optical, acoustical or other forms of propagated signals (e.g., carrier waves, infrared signals, digital signals, etc.), and others. Further, firmware, software, routines, instructions may be described herein as performing certain actions. However, it should be appreciated that such descriptions are merely for convenience and that such actions in fact results from computing devices, processors, controllers, or other devices executing the firmware, software, routines, instructions, etc. Further, any of the implementation variations may be carried out by a general purpose computer.

For the purposes of this discussion, the term "processor circuitry" shall be understood to be circuit(s), processor(s), logic, or a combination thereof. A circuit includes an analog circuit, a digital circuit, state machine logic, data processing circuit, other structural electronic hardware, or a combination thereof. A processor includes a microprocessor, a digital signal processor (DSP), central processor (CPU), application-specific instruction set processor (ASIP), graphics and/or image processor, multi-core processor, or other hardware processor. The processor may be "hard-coded" with instructions to perform corresponding function(s) according to aspects described herein. Alternatively, the processor may access an internal and/or external memory to retrieve instructions stored in the memory, which when executed by the processor, perform the corresponding function(s) associated with the processor, and/or one or more functions and/or operations related to the operation of a component having the processor included therein.

In one or more of the exemplary embodiments described herein, the memory is any well-known volatile and/or non-volatile memory, including, for example, read-only memory (ROM), random access memory (RAM), flash memory, a magnetic storage media, an optical disc, erasable programmable read only memory (EPROM), and programmable read only memory (PROM). The memory can be non-removable, removable, or a combination of both.

REFERENCE LIST

1 transport direction (of the recording medium)
2 movement direction (of a print bar or of a print head)
21, 22 nozzle
31, 32 column (of the print image)
100 printing device
101 controller
102 print bar
103 print head
120 recording medium
140 print group
150 cleaner
151 wiper
152 wiper cleaning
153 sled
154 guide rail
155 spray nozzle
170 nozzle plate
172 cleaning nozzle
173 cleaning fluid
174 wave or surge of cleaning fluid
175 fluid opening
176 actuator (pump)
177 overflow
178 guide wall
180 roller
181 rotation direction
182 cleaning textile
201 print data
202 boundary condition data
203 quality sensor
250 cleaner
211, 212 value (quality indicator)
220 point in time
221, 222 cleaning method
350 cleaning unit
400 method for cleaning a nozzle plate of a print head
401-402 method steps

The invention claimed is:

1. A cleaning unit for a nozzle plate of a print head of an inkjet printing device, comprising:

a first cleaner that is configured to clean the nozzle plate with a first cleaning quality and with a first mechanical loading of a functional surface of the nozzle plate;

a second cleaner that is configured to clean the nozzle plate with a second cleaning quality and with a second mechanical loading of the functional surface of the nozzle plate; and a controller that is configured to:

determine, based on a print image sensor data with respect to a print image printed with the print head, a time curve of a quality indicator for a quality of the print image printed with the print head;

determine, based on the time curve, a cleaning indicator that indicates a need for cleaning of the nozzle plate of the print head; and induce, based on the cleaning indicator, the nozzle plate to be cleaned with the first cleaner and/or the second cleaner.

2. The cleaning unit according to claim 1, wherein the first cleaning quality is less than the second cleaning quality, and the first mechanical loading is less than the second mechanical loading.

3. The cleaning unit according to claim 1, wherein the nozzle plate is cleaned with the first cleaner and/or with the second cleaner, based on the cleaning indicator, to maintain a print quality produced by the print head above a minimum quality, and to maintain a service life of the functional surface of the nozzle plate above a minimum duration.

4. The cleaning unit according to claim 1, wherein the cleaning indicator is determined based on a value of the time curve.

5. The cleaning unit according to claim 1, wherein the cleaning indicator is determined based on a slope of the time curve.

6. The cleaning unit according to claim 1, wherein the controller is configured to determine the cleaning indicator based on boundary condition data indicative of one or more boundary conditions for a printing operation of the printing device.

7. The cleaning unit according to claim 6, wherein the one or more boundary conditions comprise:

a temperature in an environment of the print head;

a humidity in an environment of the print head;

a type and/or a property of a recording medium that is printed to by the print head; and a type and/or a property of ink that is ejected by the print head.

8. The cleaning unit according to claim 1, wherein the controller is configured to:

determine a degree of the intensity with which the print head has been used since a most recent cleaning; and determine the cleaning indicator based on the determined degree of the intensity.

9. The cleaning unit according to claim 1, wherein the controller is configured to:

use only the first cleaner to clean the nozzle plate if the cleaning indicator indicates a first need for cleaning of the nozzle plate of the print head; and use only the second cleaner to clean the nozzle plate if the cleaning indicator indicates a second need for cleaning of the nozzle plate of the print head, the second need for cleaning being higher than the first need for cleaning.

10. The cleaning unit according to claim 1, wherein:

the first cleaner and the second cleaner are arranged along an axis such that the nozzle plate of the print head may be cleaned by both the first cleaner and the second cleaner with a single translatory movement; and the translatory movement travels orthogonal to a transport direction of a recording medium that is printed to by the print head.

11. The cleaning unit according to claim 10, wherein the second cleaner is configured to be moved past the nozzle plate or away from the nozzle plate in order to enable or prevent a cleaning with the second cleaner.

12. The cleaning unit according to claim 1, wherein:

the first cleaner is configured to clean the nozzle plate with a surge of cleaning fluid; and the second cleaner is configured to wipe off the nozzle plate with an elastic wiper and/or with a cleaning textile.

13. A method for cleaning a nozzle plate of a print head of an inkjet printing device having a first cleaner and a second cleaner, the method comprising:

determining, based on a print image sensor data with respect to a print image printed with the print head, a time curve of a quality indicator for a quality of the print image printed with the print head;

determining, based on the time curve, a cleaning indicator that indicates a need for cleaning the nozzle plate of the print head; and cleaning, based on the cleaning indicator, the nozzle plate with the first cleaner and/or with the second cleaner, wherein the first cleaner is configured to clean the nozzle plate with a first cleaning quality and with a first loading of the nozzle plate, and the second cleaner is configured to clean the nozzle plate with a second cleaning quality and with a second loading of the nozzle plate.

14. The method according to claim 13, wherein the first cleaning quality is less than the second cleaning quality.

15. The method according to claim 13, wherein the first loading of the nozzle plate is less than the second loading of the nozzle plate.

16. The method according to claim 13, wherein:

the first cleaning quality is less than the second cleaning quality; and the first loading of the nozzle plate is less than the second loading of the nozzle plate.

17. A non-transitory computer-readable storage medium with an executable program stored thereon, that when executed, instructs a processor to perform the method of claim 13.

* * * * *